US005081976A

United States Patent [19]

Dahm et al.

[11] Patent Number: 5,081,976

[45] Date of Patent: Jan. 21, 1992

[54] BUCKET TAPPET FOR AN INTERNAL COMBUSTION ENGINE WITH OVERHEAD CAMSHAFT

[75] Inventors: Rolf-Wolfram Dahm, Nürtingen; Hermann Vollmer, Stuttgart; Erwin Wolf, Weissach, all of Fed. Rep. of Germany

[73] Assignee: Mercedes-Benz AG, Fed. Rep. of Germany

[21] Appl. No.: 539,210

[22] Filed: Jun. 18, 1990

[30] Foreign Application Priority Data

Jun. 16, 1989 [DE] Fed. Rep. of Germany ..... 3919777

[51] Int. Cl.[5] ..... F01L 1/14; F01L 1/24

[52] U.S. Cl. ..... 123/90.48; 123/90.51; 123/90.55; 74/569

[58] Field of Search ..... 123/90.48, 90.49, 90.5, 123/90.51, 90.52, 90.55; 74/569

[56] References Cited

U.S. PATENT DOCUMENTS

| | | | |
|---|---|---|---|
| 4,367,701 | 1/1983 | Buente | 123/90.55 |
| 4,470,381 | 9/1984 | Buente et al. | 123/90.55 |
| 4,590,898 | 5/1986 | Buente et al. | 123/90.55 |
| 4,610,225 | 9/1986 | Camosso et al. | 123/90.55 |
| 4,756,282 | 7/1988 | Kunz et al. | 123/90.55 |
| 4,924,825 | 5/1990 | Speil | 123/90.55 |

FOREIGN PATENT DOCUMENTS

| | | | |
|---|---|---|---|
| 0160287 | 11/1985 | European Pat. Off. | 123/90.55 |
| 3409235 | 9/1985 | Fed. Rep. of Germany | 123/90.55 |
| 8605238 | 9/1986 | PCT Int'l Appl. | 123/90.55 |

*Primary Examiner*—E. Rollins Cross
*Assistant Examiner*—Weilun Lo
*Attorney, Agent, or Firm*—Evenson, Wands, Edwards, Lenhahn & McKeown

[57] ABSTRACT

A bucket tappet for an internal combustion engine with overhead camshaft comprises a hollow cylindrical tappet shank made of an aluminum material which is closed at one end by a baseplate made of a steel or hard metal material. A guide bush for accommodating a play-compensating element is arranged inside the tappet shank and is concentric to the longitudinal center axis. In order to obtain a permanent connection between the baseplate and the tappet shank, a steel material carrier element is embedded in the tappet shank and the baseplate is secured by soldering or welding to the carrier element.

12 Claims, 1 Drawing Sheet

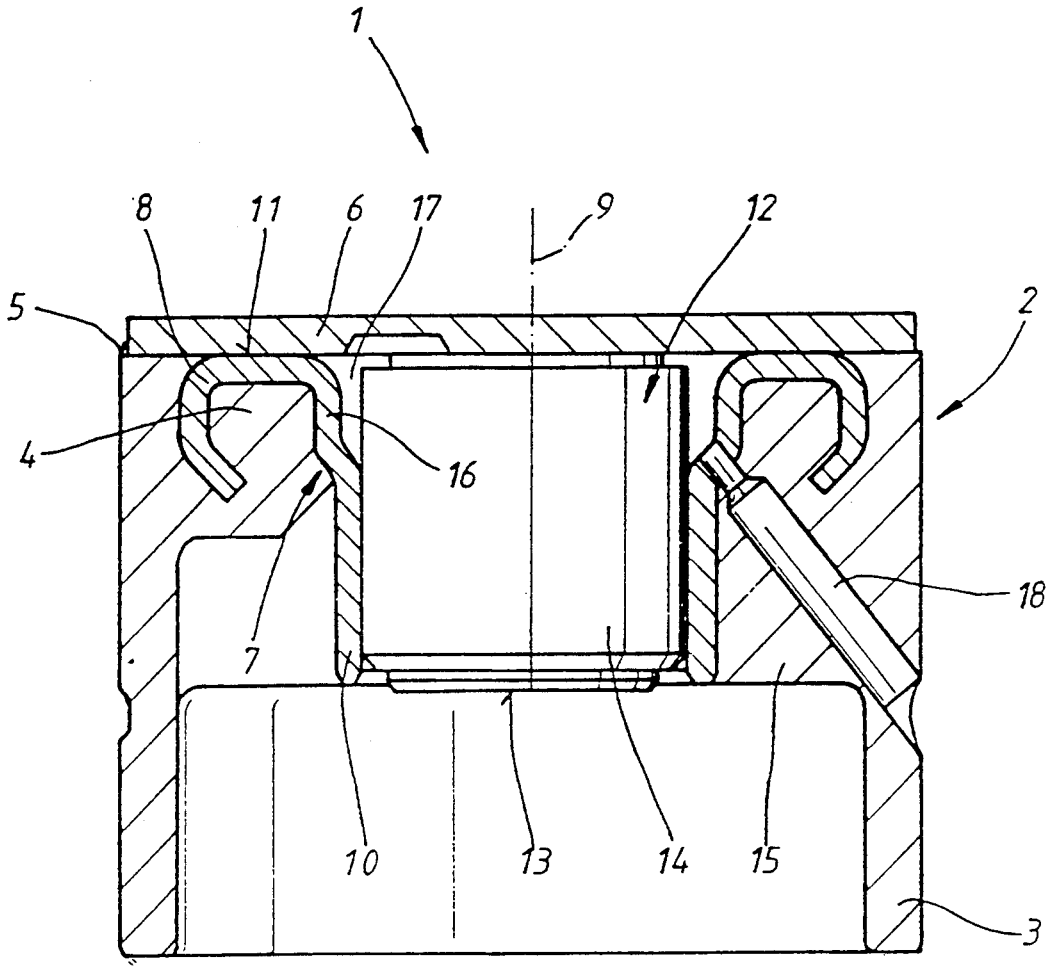
1
8
11
6
17
9
12
5
2
4
16
18
7
10
13
14
15
3

BUCKET TAPPET FOR AN INTERNAL COMBUSTION ENGINE WITH OVERHEAD CAMSHAFT

BACKGROUND AND SUMMARY OF THE INVENTION

The present invention relation to a bucket tappet for an internal combustion engine with overhead camshaft, and, more particularly, to a bucket tappet in the form of a hollow cylindrical tappet shank, a baseplate supported on a bead of the shank and a guide bush inside the shank.

A bucket tappet of the above mentioned construction is disclosed in EP-PS 0,030,780. An aluminum material tappet shank has a counter-bore at one end in which a hand metal baseplate, is inserted and held by pressing the circumferential collar on the tappet shank against it. The press fit between the baseplate and the tappet shank does not have, however, a sufficient service life. A further disadvantage of this known bucket tappet resides in the mating of different materials as between the aluminum guide bush, a steel material play-compensating element. As a result of the mating of the different materials, the annular gap provided between the two elements as a precondition of functioning of the bucket tappet increases as the operating temperature of the internal combustion engine increases. When the internal combustion engine is hot due to running, a relatively large quantity of leakage oil escapes to the outside via the annular gap, and thus the oil consumption of the internal combustion engine rises.

The object of the present invention is, therefore, a bucket tappet on which a permanent connection is obtained between the baseplate and the tappet shank.

The foregoing object has been achieved according to the present invention by providing a carrier element made of a steel material on which the baseplate is secured, which element is embedded in the tappet shank.

By virtue of the foregoing features of the present invention, the baseplate can be connected to the tappet shank by a permanent connection, such as, for example, laser welding or soldering. Furthermore, due to the design construction of the carrier element as a flanged bush arranged concentrically in the tappet shank with a flange ring bent of at right angles at one end, optimum anchoring in the aluminum material tappet shank of the steel material carrier element, is achieved. At the same time, the bush portion can be used for accommodating and guiding a play-compensating element, which thus replaces an aluminum guide bush. This has the advantage that the bush portion and the play compensating element guided therein consist of the sam material, and it is thereby possible to have a narrow annular gap between the two elements, irrespective of the operating temperature of the internal combustion engine. Due to the narrow gap, only a small quantity of leakage oil can escape to the outside, resulting in a reduced oil consumption of the engine.

A particularly hard support of the baseplate on the tappet shank is obtained by providing the flange ring with a flat bearing surface which is in the same plane as the end face of the tappet shank.

An advantage of the present invention is that a relatively rigid support of the bush portion is obtained in the radial direction relative to the shank wall by either resting the bush portion against the outside of ribs or joined to the rib by casting.

Due to an annular widened portion of the bush portion, an oil collecting space is position in front of the play-compensating element and advantageously ensures a permanent oil supply to the play compensating element during the entire operation.

BRIEF DESCRIPTION OF THE DRAWINGS

These and other objects, features and advantages of the present invention will become more apparent from the following detailed description of a presently preferred embodiment of the present invention when taken in conjunction with the accompanying sole figure which is a cross sectional deviation view of the bucket tappet in accordance with the present invention.

DETAILED DESCRIPTION OF THE DRAWINGS

A bucket tappet designated generally by the numeral 1 is designed for an internal combustion engine with an overhead camshaft. The tappet 1 includes hollow, aluminum material cylindrical tappet shank 2 which has an annular bead 4 protruding inwardly from the shank wall 3, so as to form, towards the outside, a flat supporting surface 5 for supporting a baseplate 6. The baseplate 6 consists of a steel or a hard metal material, on which a control cam of the camshaft (not shown here) rolls a carrier element designated generally by the numeral 7 and manufactured from a steel material is embedded in the shank 2 to connect the baseplate 6 to the shank 2. To achieve a permanent joint, the baseplate 6 is here, for example, soldered or laser-welded to the carrier element 7. The carrier element 7 is in the illustrated embodiment a flanged bush which has a flange ring 8 embedded in the bead 4 and a bush portion 10 extending away from the flange ring 8 concentrically to the longitudinal center axis 9 towards the open tappet side. In order to achieve good anchoring of the flange ring 8 in the bead 4 in this embodiment, the bead 4 has a hook-shaped form. The flange region of the flange ring 8 which extends outwardly at right angles to the bush portion 10 is designed as a flat bearing surface 11. The flanged bush carrier element 7 is embedded in the tappet shank 2 in such a way that the bearing surface 11 of the flange ring 8 lies in the same plane as the supporting surface 5 and is thus part of the support surface 5. This is advantageous since the baseplate 6 rests with a large portion of its surface on the relatively rigid flanged bush carrier element 7, and the supporting surface 5 is easily accessible from the outside.

The bush portion 10 serves to guide a play-compensation element 12 which rests against the inside of the baseplate 6 and presses with a thrust face 13 on the piston 14 on the stem of a gas-exchange valve (not shown). Since, in a manner similar to the bush portion 10, the play compensating element 12 is made from a steel material, it is possible to guide the piston 14 with a relatively small clearance in the bush portion 10. Hence, the leakage oil losses from the play-compensating element 12 are thereby reduced overall. In addition, the bush portion 10 is secured in the radial direction by ribs 15 integrally cast on the shank wall 3 and leading radially inwards as far as the bush portion 10. In the region of transition to the flange ring 8, the bush portion 10 has a widened portion 16 which, with the play compensating element 12, encloses an oil space 17 which is connected by a bore 18 to the lubricating oil circuit of the internal combustion engine.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A bucket tappet for an internal combustion engine with overhead camshaft, comprising a hollow, aluminum material cylindrical tappet shank with an annular bead directed radially inwardly at an end of the tappet shank, a baseplate supported outwardly of the annular bead and made of a material selected from a steel material and a hard metal material, a concentrically arranged guide bush inside the tappet shank for accommodating a play-compensating element, and supported against a wall of the shank by radial ribs, and a steel material carrier to which the baseplate is secured is embedded in the tappet shank.

2. The bucket tappet according to claim 1, wherein the baseplate is secured to the carrier by soldering and welding.

3. The bucket tappet according to claim 1 wherein the carrier is a flanged bush arranged concentrically in the tappet shank and has a flange ring, which is bent outwardly at right angles at an end, and the carrier is embedded in the bead of the shank and has a bush portion which constitutes the guide bush for the play compensating element.

4. The bucket tappet according to claim 3, wherein the baseplate is secured to the carrier by soldering and welding.

5. The bucket tappet according to claim 3, wherein the flange ring is provided with a flat bearing surface embedded in the bead such that the flat bearing surface and an end face of the tappet shank are in the same plane.

6. The bucket tappet according to claim 5, wherein the baseplate is secured to the carrier by soldering and welding.

7. The bucket tappet according to claim 3, wherein the bush portion rests against or is joined by casting to the ribs.

8. The bucket tappet according to claim 7, wherein the baseplate is secured to the carrier by soldering and welding.

9. The bucket tappet according to claim 7, wherein the flange ring is provided with a flat bearing surface embedded in the bead such that the flat bearing surface and an end face of the tappet shank are in the same plane.

10. The bucket tappet according to claim 3, wherein the bush portion has an annular widened portion on a region of transition to the flange ring and delimits an oil collecting space which is connected, via a bore, to a lubricating oil circuit of the internal combustion engine.

11. The bucket tappet according to claim 10, wherein the flange ring is provided with a flat bearing surface embedded in the bead such that the flat bearing surface and an end face of the tappet shank are in the same plane.

12. The bucket tappet according to claim 10, wherein the baseplate is made of a material selected from a steel material and a hard metal material.

* * * * *